United States Patent [19]

Breitkreuz et al.

[11] Patent Number: 4,683,861

[45] Date of Patent: Aug. 4, 1987

[54] APPARATUS FOR VENTING A FUEL TANK

[75] Inventors: Helmut Breitkreuz, Ingersheim; Albrecht Clement, Kornwestheim; Dieter Mayer; Claus Ruppmann, both of Stuttgart; Dieter Walz, Fellbach; Ernst Wild, Weissach-Flacht; Martin Zechnall, Schwieberdingen, all of Fed. Rep. of Germany

[73] Assignee: Robert Bosch GmbH, Stuttgart, Fed. Rep. of Germany

[21] Appl. No.: 822,012

[22] Filed: Jan. 24, 1986

[30] Foreign Application Priority Data

Jan. 26, 1985 [DE] Fed. Rep. of Germany ..... 3502573

[51] Int. Cl.[4] ..... F02M 39/00

[52] U.S. Cl. ..... 123/520; 123/458

[58] Field of Search ..... 123/519, 520, 518, 516, 123/458, 489

[56] References Cited

U.S. PATENT DOCUMENTS

| | | | |
|---|---|---|---|
| 3,690,307 | 9/1972 | O'Neill | 123/520 |
| 4,013,054 | 3/1977 | Balsley | 123/519 |
| 4,343,281 | 8/1982 | Uozumi | 123/520 |
| 4,377,142 | 3/1983 | Otsuka | 123/520 |
| 4,467,769 | 8/1984 | Matsumura | 123/520 |
| 4,499,880 | 2/1985 | Miki | 123/489 |
| 4,527,532 | 7/1985 | Kasai | 123/520 |
| 4,530,210 | 7/1985 | Yamazaki | 123/520 |

FOREIGN PATENT DOCUMENTS

| | | | |
|---|---|---|---|
| 0041443 | 3/1982 | Japan | 123/520 |
| 0213941 | 12/1984 | Japan | 123/520 |

OTHER PUBLICATIONS

"Vapor Purge Control", Research Disclosure No. 17419, Disclosed Anonymously, Oct. 1978.

*Primary Examiner*—Carl Stuart Miller
*Attorney, Agent, or Firm*—Walter Ottesen

[57] ABSTRACT

An apparatus is disclosed for venting a fuel tank of internal combustion engines or the like, wherein fuel vapors developing in the tank are received in an intermediate storage unit containing an activated carbon filter and are delivered to the induction area of the engine in dependence upon operating conditions. The delivery is accomplished by an electrically controlled tank venting valve having a pass-through opening the cross section of which is continuously changed. This is achieved by changing the pulse duty factor of the drive pulse train for this valve. The pulse duty factor may be determined in the sense of a pure control using a family of characteristic fields in dependence on rotational speed and load of the engine, or by taking into account preferably averaged Lambda values with a reduction in the cross section of the pass-through opening of the tank vent valve as the mixture becomes richer. Further, an adaptive anticipatory control is provided which enters into the calculation of the fuel quantity to be supplied or of the fuel injection signal with a correction value (ATE) and switches over to a limit control when predetermined mixture proportions are reached. The basic adaptation in the Lambda control system for calculating the fuel supply is released only if the fuel quantities originating from tank venting are negligible.

30 Claims, 19 Drawing Figures a.)
TE
100 %
0%
t
b.)
TVTE
TVTE min1
TVTE min2
t
t1
t2
t3
c.)
ATE
ATE max
ATE min
t
Start Basic Adaptation
Limit Control
d.)
FR
1,1
1
des.
0,9
t Tank Venting Decision Matrix Table

| | Variant (Quantity Q) | Variation Tank Venting Valve | Scavenging Quantity (LL=Idling) (TL=Part Load) | Error | Adaptation | Variation Tank Venting (TE) Characteristic Field | Remarks |
|---|---|---|---|---|---|---|---|
| 1. | Upstream of Throttle Flap | 1:20 | | | | | 20 mbar $\leqq \Delta p \leqq$ 30 mbar |
| 1.1 | $Q_{TE}$=const. | 1:20 | constant at LL large at TL | additive to air | effective in sub-range | 1:1.2 (because of $\Delta p$) | most simple and efficient variant |
| 1.2 | $Q_{TE}/Q_L$=const. | 1:20 | small at LL large at TL | multiplicative | always effective | 1:8 (because of $Q_L$, $\Delta p$) | scavenging quantity small at idling |
| 2. | into intake pipe | 1:110 | | | | | 30 mbar $\leqq \Delta p \leqq$ 900 mbar |
| 2.1 | $Q_{TE} \cdot n$=const. | 1:110 | large at LL small at TL | additive to $t_L$ | effective in sub-range | 1:22 (because of $\Delta p$, n) | tank venting characteristic complicated |
| 2.2 | anticipatory control=const. | 1:110 | large at LL minimal at TL | complex | complex | 1:1 | not recommended |

Fig. 12

APPARATUS FOR VENTING A FUEL TANK

FIELD OF THE INVENTION

The invention relates to an apparatus for venting a fuel tank of an internal combustion engine or the like. The apparatus includes an intermediate storage for receiving fuel vapors which form and means for delivering the vented mixture in a controlled manner.

BACKGROUND OF THE INVENTION

In internal combustion engines, tank venting systems are known wherein the fuel vapors developing on account of and in dependence on specific parameters (fuel temperature, fuel quantity, vapor pressure, air pressure, scavenging quantity, et cetera) are not merely vented off into atmosphere and are instead directed into the engine. Conventionally, this is accomplished by providing an intermediate storage filled with, for example, activated carbon which receives the fuel vapors developing, for example, when the vehicle is stationary and directs them to the intake area of the engine via a conduit. In this connection, it is further known to prevent or minimize increased exhaust emissions which may occur as a result of such an additional air-fuel mixture attributable to tank venting by releasing the tank venting function only under specific operating conditions of the engine. For the foregoing, reference can be made to the publication of Robert Bosch GmbH entitled "Motronic"—Technische Beschreibung C5/1 of August 1981 and German published patent application DE-OS No. 2,829,958.

The intermediate storage container accommodating the activated carbon filter can store fuel vapors up to a specific maximum amount, with the filter being scavenged during engine operation by the vacuum pressure generated by the engine in the intake ducting for which the filter has an opening to the atmosphere. As a result, even if scavenging of the intermediate storage unit is only permitted under specific operating conditions, tank venting necessarily produces an additional air-fuel mixture which, being either not measured or not measurable at reasonable expense, tampers with the fuel metering signal, that is, in a fuel injection system, the duration of the injection control instruction $t_i$, which is normally computed in a complex procedure with a very high degree of accuracy, and tampers with the resultant fuel quantity supplied to the internal combustion engine. Such an additional fuel quantity which affects particularly also the driveability under specific conditions and which, in extreme cases, may consist of almost 100% vented air or 100% vented fuel vapor, is not acceptable, not even if the impact of this disturbance is directly related to the intake pressure developed by the internal combustion engine by means of pneumatic final controlling elements, nor if an electronic on/off control is provided which cuts off the supply of the tank venting mixture completely in the presence of particularly sensitive operating conditions, such as at idling.

SUMMARY OF THE INVENTION

It is, therefore, an object of the invention to provide an apparatus which delivers the tank venting mixture, the proportions or quantities of which are not predeterminable, to the intake ducting of the internal combustion engine such that the temporary storage unit is effectively vented on the one hand, while on the other hand, the operation of the internal combustion engine is not adversely affected. Particularly with fuel metering devices operating under a Lambda control (for example, fuel injection systems or controlled carburetors or the like), no disturbances are superposed in a manner bringing the control to a limit stop or, with adaptive anticipatory control systems, no longer-term deviations of the controller output (which are, however, only attributable to the additional influence of the tank venting mixture), anticipatory control corrections are introduced which materially affect the adaptation action.

This object is accomplished with the apparatus of the invention which has the decisive advantage that the influence of the tank venting function is eliminated from the range of random break-ins and is specifically fine-adjusted to the behavior of the internal combustion engine, with the maximum quantity to be supplied being altered continuously. In this apparatus, it is in particular also the tank venting range which is controlled in dependence on the Lambda control of the air-fuel mixture anyway available in internal combustion engines, so that neither the driveability nor the control can be adversely affected.

A particular advantage is the control of tank venting in the sense of an anticipatory control using load-rotational speed characteristics, with this anticipatory control being further made dependent on the Lambda control factor.

Particularly advantageous is the introduction of a limit control acting additionally or also solely in connection with the load-rotational speed characteristics, using the limit value of a minimum permissible Lambda control factor, and finally an anticipatory tank venting control which is set to a minimum value at start, in the overrun cutoff mode of operation and with the Lambda control inactive, as well as another limit control using the limit value of a minimum permissible adaptation value.

In this arrangement, the deviation of the control factor from the desired value as caused by tank venting results in a drift of a correction value which is then included in the calculation of the injection signal, applied to a fuel injection system, such that a constant fuel or air quantity is compensated, independently of load and rotational speed. In this manner, it is possible to eliminate the influence of tank venting on the Lambda control and the pertinent adaptation of the anticipatory control of the fuel injection signal. Therefore, changes in the composition of the tank venting mixture and load changes are not apt to impair driveability.

Further, it is an advantage that the vent valve in the tank vent line between the filter and the intake duct is periodically controlled by the associated control unit, with the period ensuing from the alternate opening and closing of the valve, and that a variation of this ratio between opening and closing period (which corresponds to the pulse duty factor of the tank venting control) permits a corresponding adjustment of the tank venting mixture quantity. This provides a wide range over which, in dependence on the Lambda control factor, also tank venting can be included in the overall behavior of an internal combustion engine in the sense of a control and can be implemented.

BRIEF DESCRIPTION OF THE DRAWING

The invention will now be described in more detail in the following with reference to the drawing wherein.

DESCRIPTION OF THE PREFERRED EMBODIMENTS OF THE INVENTION

Figure 1:
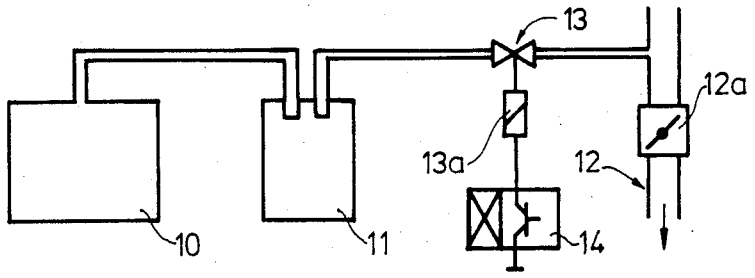
FIG. 1 is a simplified schematic depicting the basic principle of tank venting wherein the apparatus includes a tank venting valve having a cross-sectional opening that is continuously changeable and an electronic control unit.

FIG. 1 shows a fuel tank 10 which is aerated and de-aerated exclusively through an activated carbon filter arranged in an intermediate storage unit 11, with the fuel evaporating from the tank being held in the activated carbon filter up to a limited maximum amount. With the internal combustion engine running (FIG. 1 shows only the induction area 12 with throttle flap 12*a*), this stored fuel is then drawn into the engine. The metering of the fuel withdrawn from the tank venting region or of the air-fuel mixture formed therein, the proportions of which are not determinable, is accomplished by means of a special tank venting valve 13, such that in all operating conditions of the system neither driveability nor emission quality nor the control systems and adaptive systems involved in the metering of the fuel are impaired.

The tank venting valve 13 is controlled by a control unit 14 acting on the valve solenoid 13*a*. The control unit 14 issues a drive pulse train with a variable pulse duty factor TV whereby a suitable cross section of opening of the tank venting valve 13 can be adjusted. The characteristic of the tank venting valve 13 may follow an approximately linear or, where applicable, also exponential course between minimum throughput $Q_{min}$ and maximum throughput $Q_{max}$ against the pulse duty factor, which can be taken into consideration in the calculation.

The following relates to especially numerical data of a suitable tank venting valve having a through opening the cross section of which is continuously changeable in dependence on the pulse duty factor of the drive pulse train.

Figure 2:
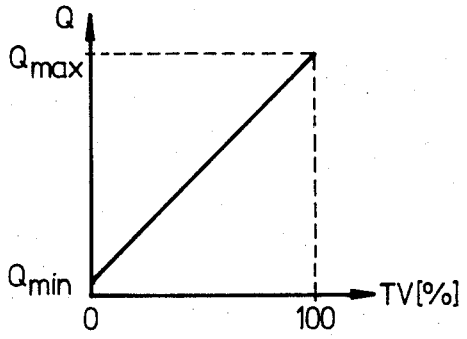
FIG. 2 is a graphical representation of the approximately linear course of the characteristic of the tank venting valve plotted against the pulse duty factor of the drive pulse train.

Advantageously, the tank venting valve is based on the principle of a lifting magnet which is open in the de-energized state and controlled by a suitable clock pulse frequency of 10 Hz. At a pressure differential of $\Delta p = 20$ mbar, a maximum throughput of $2 < Q \leqq 4$ m³/h will result; with the same pressure differential, the minimum throughput will then be $0 < Q \leqq 0.1$ m³/h. In this preferred embodiment, the variation between $Q_{min}$ and $Q_{max}$ which can be produced via the pulse duty factor is at a ratio of 1 to 20. A corresponding characteristic curve is shown in FIG. 2 qualitatively.

Figure 3:
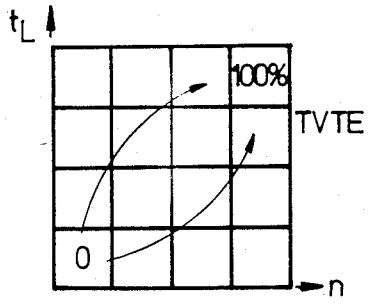
FIG. 3 is a graphical representation showing a tank venting characteristic field for anticipatory control of the pulse duty factor of the drive pulse train for the tank vent valve, plotted against load and rotational speed.
Figure 7:
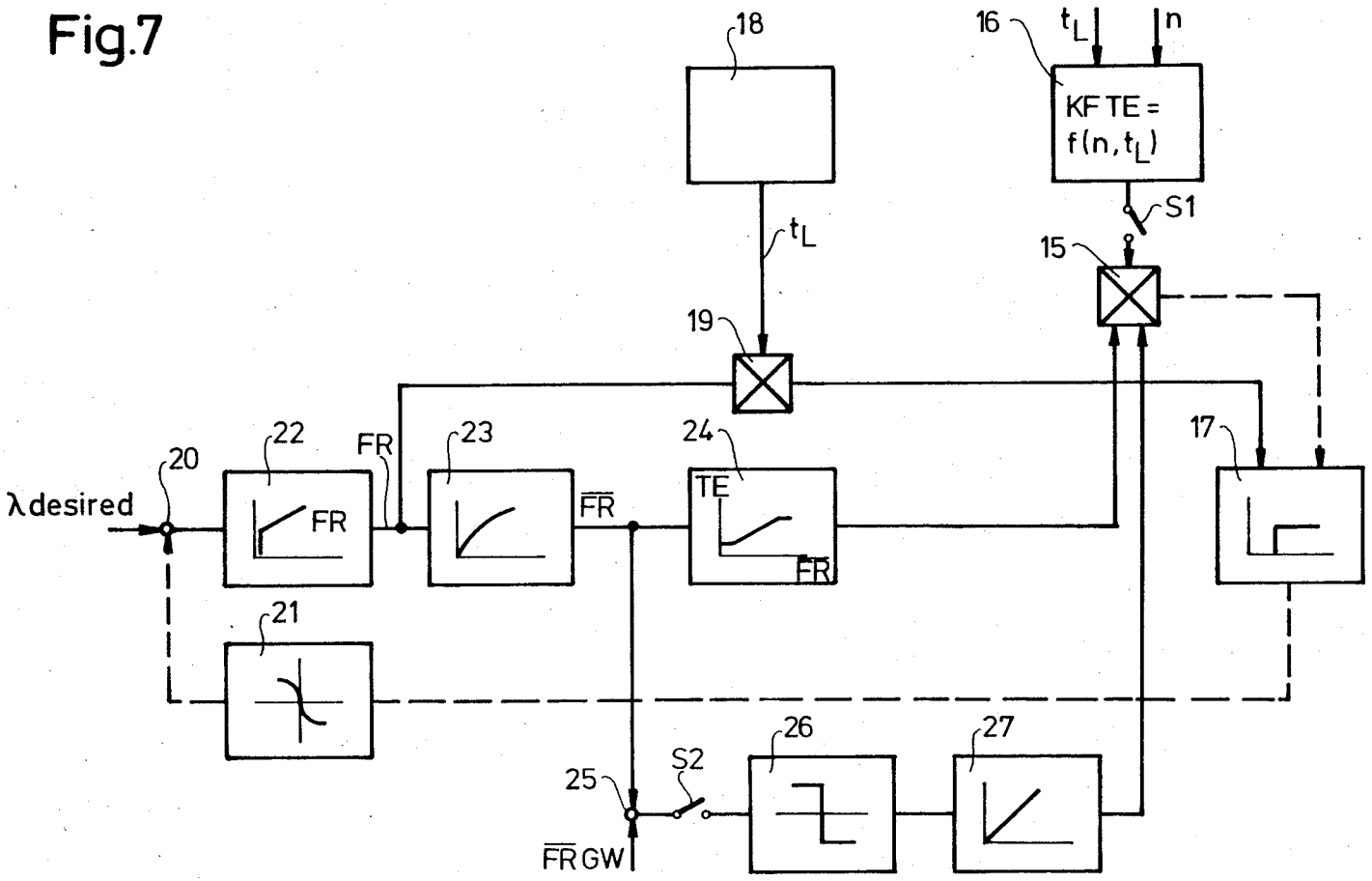
FIG. 7 is a schematic block diagram of the tank venting function with an anticipatory control characteristic field and an optional supplementary intervention of a Lambda-control-dependent control and a limit control.

In respect of the further functions of tank venting TE, reference will be made to the block diagram of FIG. 7; a first embodiment which possesses inventive merit also independently of other tank venting control possibilities acting, where applicable, in a complementing and supporting capability, includes the control of the tank venting valve via tank venting characteristics or anticipatory control characteristics which, in dependence on load (in this embodiment shown as anticipatory control injection pulse $t_L$ of a fuel injection system) and rotational speed n, issue quantized pulse duty quantities via $4 \times 4$ support points with the possibility of interpolation, supplying these, for example, to a multiplier 15 for the tank venting valve control. In the embodiment of FIG. 7, such anticipatory control characteristic field is identified by reference numeral 16; in FIG. 3, it is shown as a diagram, with the characteristic field to be interpreted such that the percentage enrichment of the combustion mixture supplied to the internal combustion engine is of the same magnitude in all ranges with a given tank venting mixture.

In this connection, it is to be noted that the subsequent description relates essentially to the application of tank venting to a fuel injection system, so that injection-related terms will be used in the following. It is, however, understood that this does not restrict the invention for use with only a fuel injection system but encompasses its use with any fuel metering arrangement for internal combustion engines.

Quantization of the pulse duty factor of the drive pulse train for the tank venting valve may be accomplished continuously or in steps of, for example, 10% within the range between 0 and 100%. FIG. 7 shows that multiplier 15 is controlled from anticipatory control characteristics 16 via a switch S1 which is useful to inhibit the tank venting function completely under specific operating conditions (at idle, in the overrun cutoff mode), or also to transfer control from the anticipatory control characteristics to other control methods still to be explained.

For a better understanding, FIG. 7 also shows the Lambda control loop for generating the fuel metering signal of internal combustion engine 17 which, in the present embodiment, is a spark-ignition engine (Otto engine) with injection. In this control loop, a multiplier 18 uses the output signals of a load sensor, not shown, which may be an air-flow sensor, for example, and of a rotational speed sensor to generate a load signal indicative of the duration of injection $t_L$. This signal is supplied to a subsequent second multiplier 19 which ultimately controls the injection valve(s). In multiplier 19, the duration of injection is acted upon by a correction factor $F_R$ which is a Lambda correction factor generated from the actual Lambda value produced by Lambda sensor 21 and a desired Lambda value by a Lambda controller 22 connected rearward of a comparator 20.

In an advantageous embodiment of the invention, this Lambda correction factor $F_R$, which is anyway available as a result of the Lambda control system, is used to enable also the tank venting function to be controlled in dependence upon the Lambda control.

For this purpose, the mean value $\overline{F}_R$ of the Lambda correction factor which is generated by a low pass 23 is used and is passed via a characteristic block 24 to multiplier 15 for the tank venting valve control.

Figure 4:
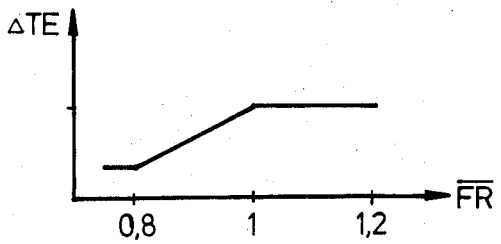
FIG. 4 is a graphical representation showing the characteristic of the mean value of the Lambda control factor for the Lambda-control-dependent control of tank venting.

The characteristic curve of the variation or influencing of tank venting relative to the mean value of Lambda control is illustrated again separately in FIG. 4. The characteristic curve includes four support points with interpolation, with the basic function being such that an increasing enrichment of the tank venting mixture is detected by means of the mean value $\overline{F}_R$ of the Lambda correction factor because of its shift to lower values and, as a result, the tank venting will be interrupted by a suitable variation of the pulse duty factor of the drive pulse train supplied to the tank venting valve.

Finally, the block diagram of FIG. 7 shows a second possibility for the characteristic mean value control. It may be used as an alternative to the first possibility and includes a limit-value control of the mean value of the Lambda correction factor. To this end, another comparator 25 is provided, receiving at its input a limit value $\overline{F}_{RGW}$ of the mean value of the Lambda correction factor as well as the actual mean value $\overline{F}_R$ of the Lambda correction factor. Via a switch S2, the result of the comparison is applied to another comparator 26 which determines whether the mean value $\overline{F}_R$ of the Lambda correction factor is above or below the predetermined limit value; depending on the result, a follow-on integrator 27 is activated as an integral controller for limit-value control with corresponding polarity, the output signal of which is likewise applied to multiplier 15.

The functions resulting from the possible tank vent control methods will now be explained with reference to the diagrams of FIGS. 5 and 6.

Figure 5:
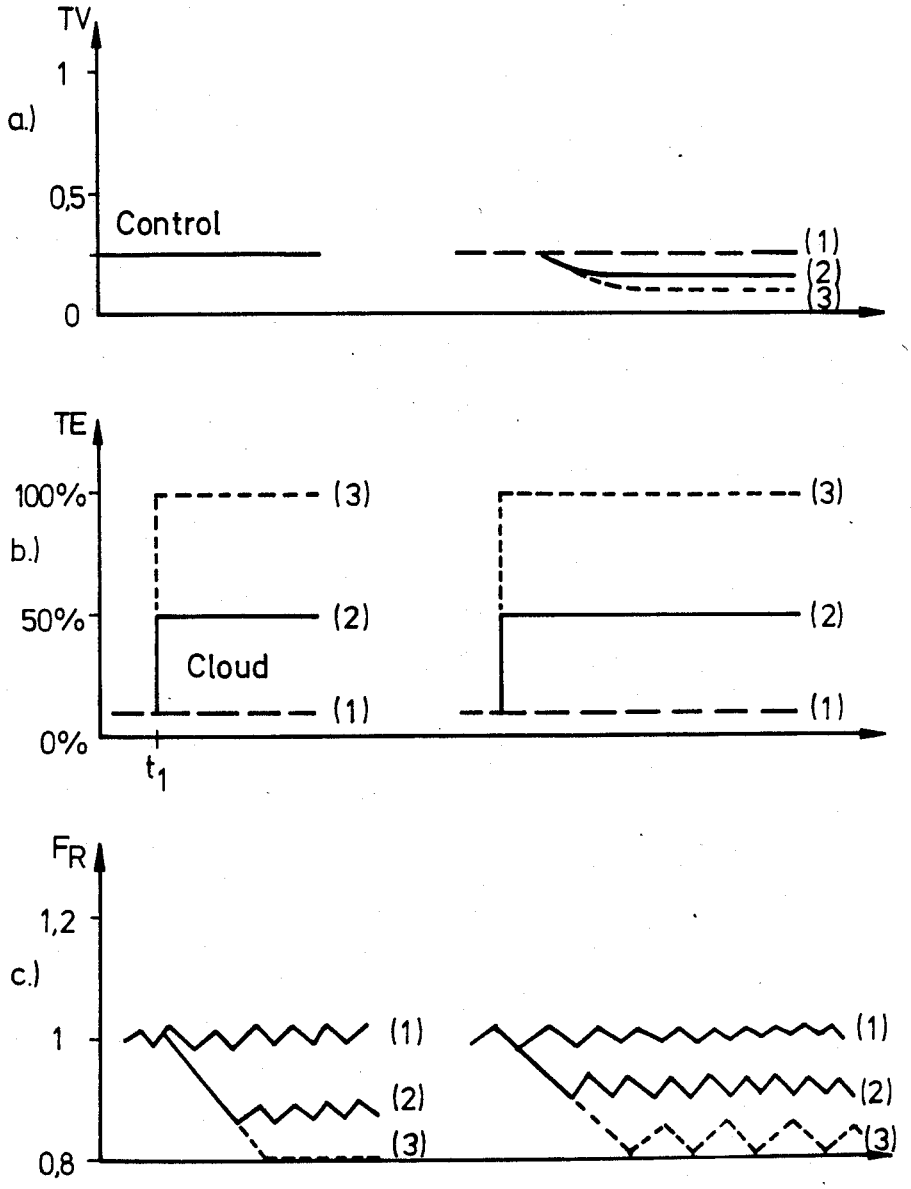
FIGS. 5*a–c* show graphical representations of the characteristics of pulse duty factor, tank venting and Lambda control factor plotted against time, each with a pure control via the tank venting characteristic field and an additional control which is dependent on the mean value of the Lambda control factor.
Figure 6:
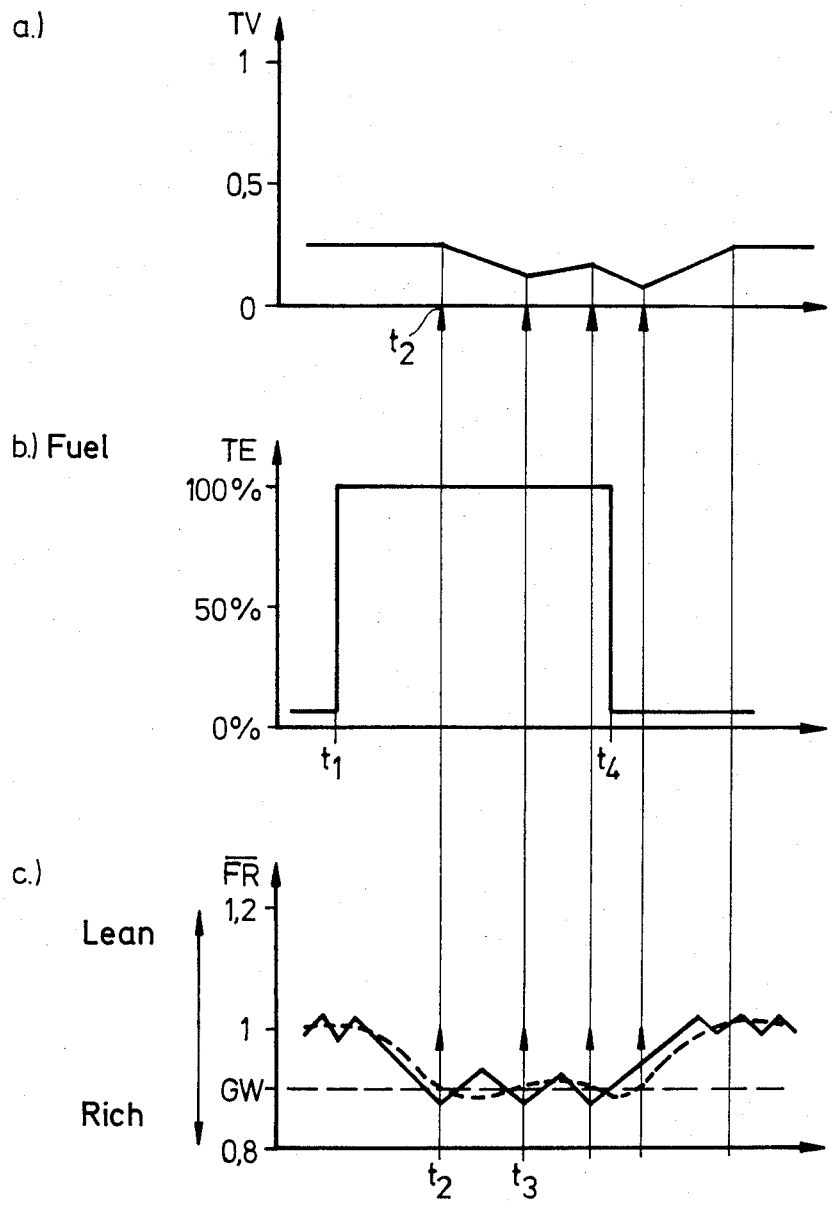
FIGS. 6*a–c* show graphical representations of the characteristic of the pulse duty factor of the drive pulse train, of tank venting and of the mean value of the Lambda control factor plotted against time with anticipatory control via the tank venting characteristic field and an additional limit control.

The diagrams on the left-hand side of FIG. 5 show the conditions resulting from a pure control using anticipatory control characteristic field 16; based on rotational speed and load values, the pulse duty factor of the control is assumed to be 0.25; if at a predetermined time $t_1$ (see FIG. 5*b*), the fuel content in the tank venting mixture increases abruptly, as shown by three different curve patterns 1, 2 and 3, the control using the anticipatory control characteristic field will not respond at all, and the Lambda correction factor $F_R$ will only experience a corresponding shift in the direction of a lean mixture as a result of the "fuel cloud" (theoretical step function) in the tank venting mixture (see FIG. 5*c*), that is, the controller leans out.

The situation is different in the diagrams on the right-hand side of FIG. 5; here, too, a pulse duty factor of 0.25 of the characteristic field control is initially assumed; then, however, the impact of the $\overline{F}_R$-dependent control results in lower pulse duty factors depending on the fuel cloud in the tank venting mixture, as shown at 2 and 3; this change in the pulse duty factor results from the anticipatory control component over the characteristic block of the Lambda mean value control and shows also a less abrupt drop in the Lambda correction factor $F_R$ in FIG. 5*c*.

By contrast, the effect of the limit control illustrated in the diagrams of FIGS. 6*a*, 6*b* and 6*c* without an $F_R$-dependent control is such that the tank venting TE is (maximally) open as a result of the pulse duty factor of the drive pulse train issued by the tank vent anticipatory control characteristic field KFTE of block 16 (numerical value in FIG. 6*a*: TV=0.25), until, at time $t_1$, tank venting fuel enrichment results in an assumed value of 100% (see FIG. 6*b*).

In accordance with the characteristic curve of the Lambda correction factor of FIG. 6*c*, represented by the solid line having a triangular profile, with the mean value $\overline{F}_R$ of the correction factor being drawn in broken lines, the enrichment thus caused by tank venting shifts the mean value $\overline{F}_R$ beyond the limit value GW, which occurs at time $t_2$. From this point on, the integral controller 27 will (progressively) diminish the pulse duty factor of the drive pulse train until, at time $t_3$, the mean value $\overline{F}_R$ has again overtraveled the limit value; from this point on, the pulse duty factor will again increase in accordance with the adjustment of the integral controller 27; multiple oscillations around the limit value GW may result in the process as shown in FIG. 6*c*, until the fuel cloud has subsided at time $t_4$ and both the mean value $\overline{F}_R$ and the pulse duty factor have returned to their previous values.

It will be understood that the time constant of the integral controller 27 for tank venting is bound to be larger than the time constant of the integral controller, known per se, of the Lambda control for fuel metering or for the calculation of the fuel injection pulses, with a constant time constant being sufficient for tank venting for the entire speed/load range. Further, a maximum limitation $I_{TEmax}$ should be provided for the integral controller, and its quantization should be about four times finer than the output quantization for the pulse duty factor.

Therefore, the overall tank venting function according to the block diagram of FIG. 7 may be expressed in the two alternative formulae given below and with the alternative complementary control possibilities occurring using the mean value of the Lambda control or the limit control additively to the characteristic control:

$$TVTE = KFTE(n, T_L) + TEF_R(\overline{F}_R)$$

$$TVTE = KFTE(n, t_L) - ITE(\overline{F}_{RGW})$$

wherein TVTE is the pulse duty factor and KFTE(n, $t_L$) is the characteristic field.

In this connection, the following boundary conditions are to be generally observed as switching conditions:

1. The output of the pulse duty factor TV is suppressed (TV=0), that is, the tank venting function is disabled, if (a) the Lambda control of the internal combustion engine is inoperative;

(b) the engine is in the overrun cutoff mode of operation; or, where applicable, (c) at idling.

2. If the supply or metering of fuel, for example, in a fuel injection system is accomplished with an adaptive anticipatory control of the Lambda control (LRA), the two functions LRA and TE (tank venting) would mutually interfere and produce an error condition. Therefore, the tank venting function TE is to be disabled when the adaptive Lambda control function LRA is enabled, and vice versa.

3. The following conditions may also apply:

(a) If the engine is started at engine temperature $T_{MOT}<30°$ C., and intake temperature $T_{ANS}<30°$ C., the tank venting TE remains closed for about ten minutes; during this time, the adaptive anticipatory control of the Lambda control (LRA) is active.

(b) This phase is followed by a tank venting phase of about five minutes whereupon TE will be closed with changing limitation. Considering the correction factor FR, LRA will then be activated if the deviation $\Delta F_R>5\%$ of the normal value $F_R=1$, and a wait will occur until $\Delta F_R 5\%$ or five minutes, maximum, have elapsed. Subsequent to this, the tank venting function TE may be resumed with changing limitation.

Another preferred embodiment of the invention includes the possibility to configure tank venting TE so as to be supplementary adaptive; stated otherwise, to configure the components involved in tank venting, namely, the switching means and control processes, such that the mixture supplied to the internal combustion engine as a result of tank venting is, so to speak, deducted when the actual mixture is formed (basic adaptation), which is a particular advantage in such fuel induction and fuel injection systems which are provided with an adaptive anticipatory control for Lambda control of their own and in which tank venting may thus entail certain difficulties to the extent that this adaptive anticipatory control (basic adaptation) makes use of the longer-term deviations of the controller output (Lambda controller) as a measure of a correction of the anticipatory control. In the embodiment of the invention described in the following, the advantages of an adaptation of the anticipatory control in the Lambda control system can be maintained and extended to cover also the tank venting function.

Figure 8:
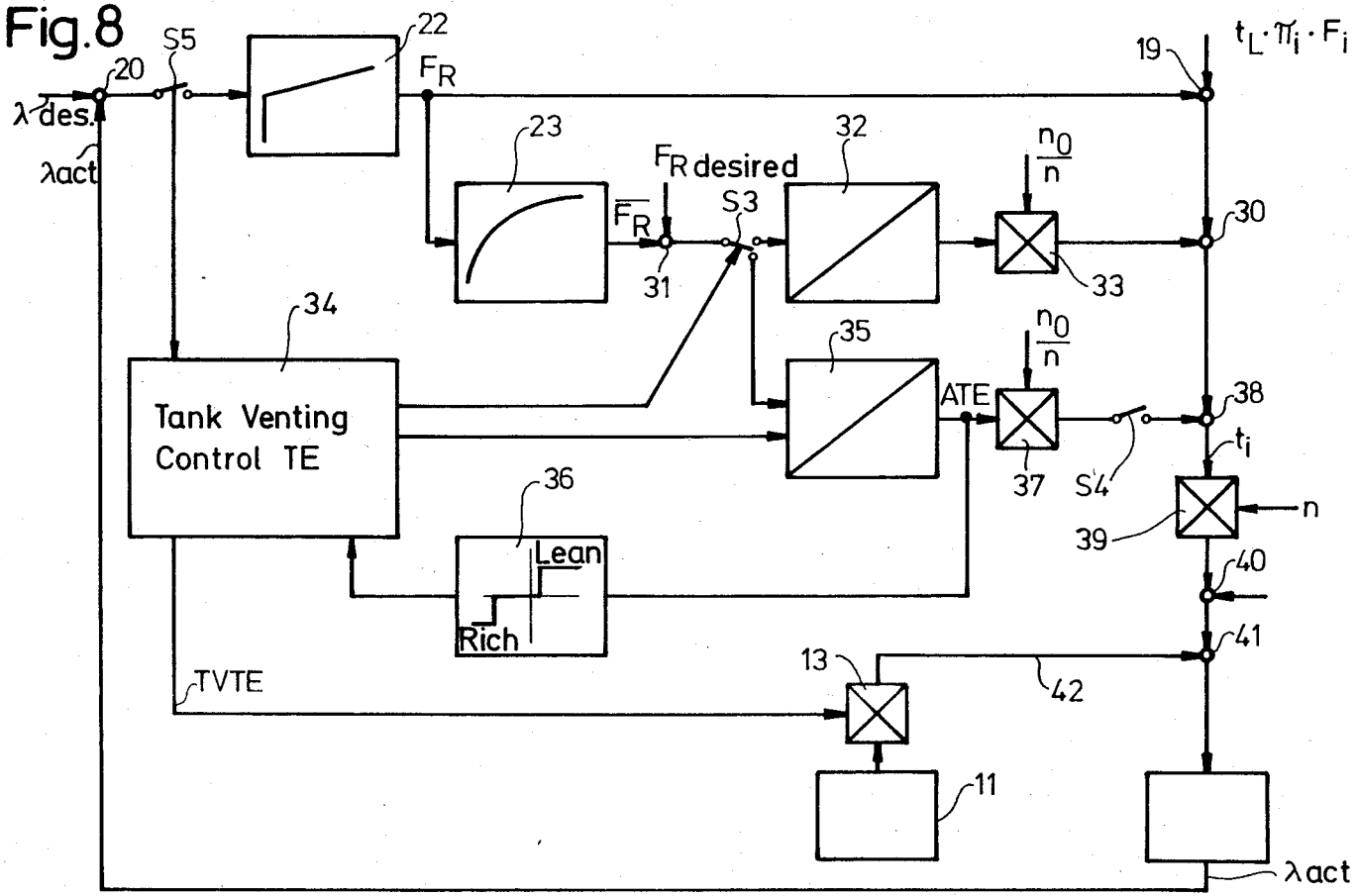
FIG. 8 is another schematic block diagram of an adaptive tank venting control with the possibility of influencing the fuel quantity delivered to the internal combustion engine by the fuel metering system.

Accordingly, the upper part of the block diagram of FIG. 8 shows schematically the Lambda control system for fuel induction using, for example, a fuel injection system with basic adaptation, while the lower part of the diagram shows the extension of the basic principle to cover an adaptive anticipatory control of tank venting. In FIG. 8, like elements and components are assigned like reference numerals as in the block diagram of FIG. 7, because the adaptive anticipatory control of tank venting continues to use at least partial sections of the block diagram of FIG. 7, such as the basic principle of the anticipatory control characteristic field 16 when specific limit values are attained, or the section in which a tank vent anticipatory control adaptation is not used, as will be explained further below with reference to FIG. 10.

In FIG. 8, the Lambda controller is again identified by reference numeral 22 and is connected with the output of the comparator 20 for comparing the actual Lambda sensor output signal with the desired value. The Lambda correction factor $F_R$ is applied to an intervention unit 19' receiving multiplicatively or additively, preferably multiplicatively, an effective duration of injection $t_L \cdot \pi_i \cdot F_i$ generated by other components of the fuel induction system, for example, a fuel injection apparatus.

Another intervention in the duration of injection occurs at 30; this intervention serves for the adaptation of the anticipatory control (basic adaptation). For this purpose, the output signal $F_R$ of the Lambda controller 22 is smoothed by a low pass 23, that is, it is subjected to averaging, and the smoothed or mean value signal $\overline{F}_R$ of the correction factor is applied, via a comparator 31 and a switch S3, to the basic adaptation block 32 which is usually a controller. In a follow-on multiplier 33, a further multiplication with a scaled rotational speed value is made; also, memory stores not shown may be provided for temporary storage of the value of the anticipatory control basic adaptation for periods of time, for example, during which a Lambda signal is not available because of an inactive Lambda sensor.

The basic adaptation controller 32 adjusts its output quantity for the multiplicative or additive factor resulting at intervention position 30 until the mean value of the output quantity of the Lambda controller 22 corresponds to the desired value applied to comparator 31 which preferably assumes the neutral value 1. It is to be understood that this anticipatory control basic adaptation may encompass various correction values (proportional to, or independent of, the rotational speed) which act to correct the calculated duration of injection in an additive or multiplicative manner depending on the load condition of the internal combustion engine, which is not shown.

The adaptive anticipatory control of tank venting which is allocated to the anticipatory control adaptation of the duration of injection includes first a logic circuit or sequential control circuit 34 illustrated as representative of all conceivable embodiments, including software configurations, as well as a tank venting adaptation block 35 to which the mean value of the Lambda correction factor $\overline{F}_R$ is applied alternatively via the above-mentioned switch S3. In this embodiment, therefore, the control factor $F_R$ is used for acting upon the tank venting, it being understood that an adaptation, for example additive, on the load value $t_L$ would also be possible.

Further, tank venting adaptation block 35 also receives information from tank venting sequential control block 34, this information including mainly the pulse duty factor of the drive pulse train for the tank venting valve 13, active Lambda control, switchover to anticipatory control characteristics, and the like. A limit value detector 36 uses the output of tank venting adaptation block 35, which is an adaptive anticipatory control value with tank venting (ATE), to establish whether this correction factor ATE (adaptation value) has reached a negative threshold ($ATE_{min}$) or a positive threshold ($ATE_{pos}$). These thresholds may also be referred to as rich or lean limit stops. A scaled rotational speed value is applied to a multiplier 37 for equivalence of the two intervention values of the basic adaptation and the tank vent adaptation. The adaptation value ATE is applied via the multiplier 37 and a switch S4 to another intervention unit 38 where $t_i$ may be further acted upon in a multiplicative or additive manner.

A subsequent multiplier 39 multiplies $t_i$ with a rotational speed n, which results in a fuel/time-air mass/-time mixture information at an adder 40. At 41, the tank vent mixture TE is applied to this mixture information.

In this arrangement, the tank vent line 42 in which the tank venting mixture is carried may be connected from the tank vent valve 13 to the intake ducting of the internal combustion engine upstream of the throttle flap, whereby the quantity of the tank venting mixture inducted remains approximately constant with the cross section of passage of the tank vent valve 13 remaining unchanged, because the underpressure upstream of the throttle flap is approximately constant and the quantity increases with the root of the underpressure. In fact, the underpressure varies somewhat against load and rotational speed also upstream of the throttle flap, so that the opening of the tank vent valve 13 has to be slightly corrected in anticipatory control characteristic field 16 KFTE=f (n, $t_L$) mentioned above in order to reach a constant quantity $Q_{TE}$. A constant quantity is also useful for the adaptive control because it can be compensated by an additive correction value. As mentioned, the following equations therefore apply:

$$\Delta p = p_{air} - p_{throttle\ flap}$$

$$Q_{TE} = \text{const} \cdot TVTE \cdot (\Delta p)^{\frac{1}{2}}$$

When the tank venting mixture is admitted downstream of the throttle flap (which is treated later with reference to a table), the underpressure and thus the quantity would vary substantially more, so that the tank venting mixture would be at its maximum precisely at idling when tank venting may be particularly disturbing, whereas it would become progressively less as a scavenging quantity as the load increases, when tank venting becomes less and less disturbing.

With reference to the block diagram of FIG. 8, the following basic functions apply.

The deviation of the Lambda control factor from the desired value $F_R=1$ causes a drift of a correction value which is included in the calculation of the injection signal as additive to the air quantity, as explained in the above, so that a constant fuel or air quantity is compensated, independently of load and rotational speed (adaptive anticipatory control). In accordance with the block diagram of FIG. 8, $t_i$ is given as delineated below:

$$t_i = (t_L + ATE \cdot n_o/n)\pi_i F_i + TVTE$$

The tank venting function is set to a minimum on start, in the overrun cutoff mode of operation and with the Lambda control inactive; the purpose is to have a defined mixture for starting the engine and resuming its speed subsequent to an overrun cutoff condition.

Figure 9:
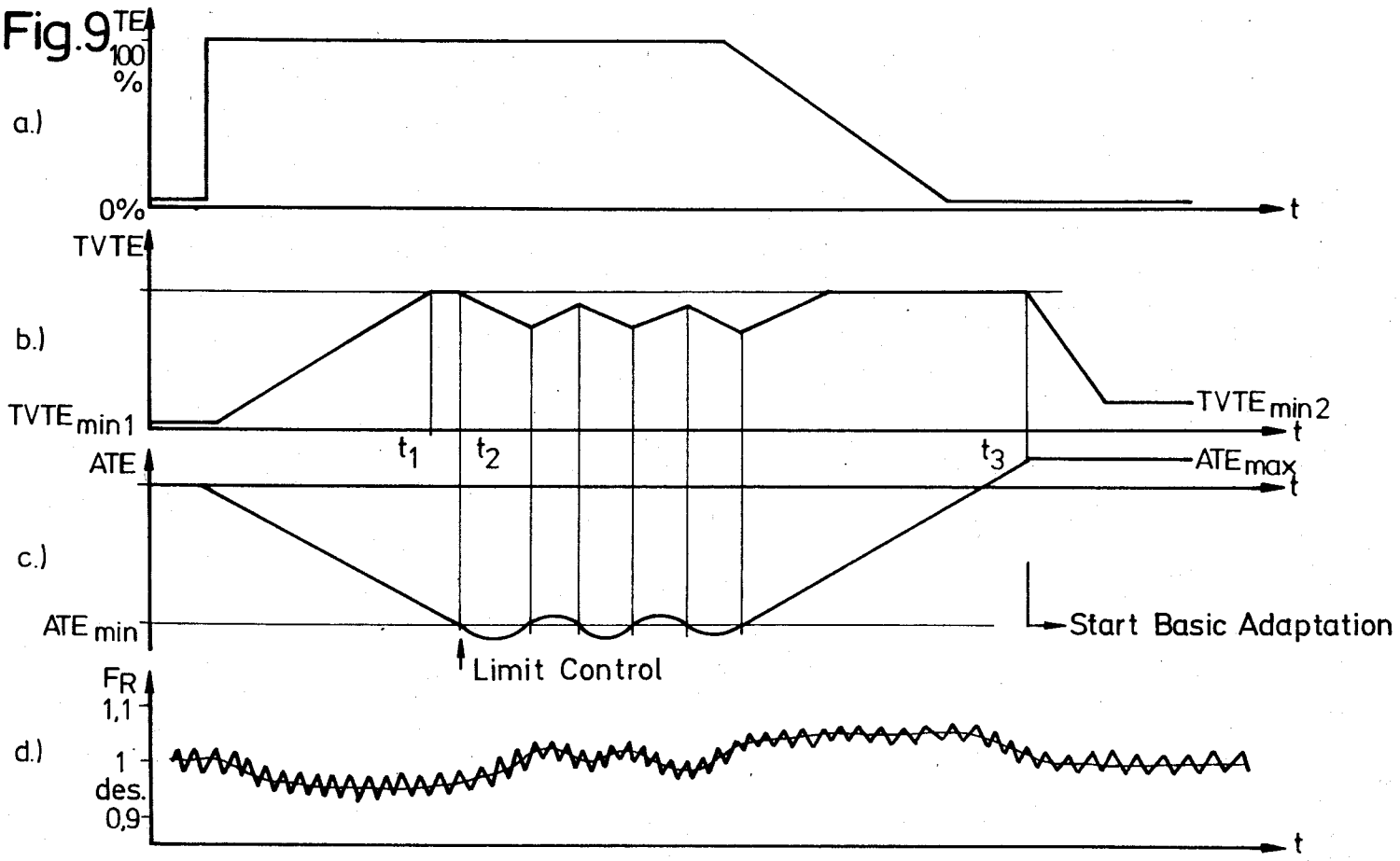
FIGS. 9*a–d* show graphical representations of the characteristics of tank venting, of the pulse duty factor of the drive pulse train, of the adaptive anticipatory control with tank venting, and of the Lambda control factor, all plotted against time.

The further operational sequence of the adaptive anticipatory control with tank venting according to the block diagram of FIG. 8, taking into consideration the data from the anticipatory control characteristics, will be explained in more detail in the following with reference to the characteristic curves of FIG. 9 for tank venting as a function of time; these function data are therefore part of the overall concept of the invention for tank venting.

If the Lambda control is active, that is, if switch S5 inserted upstream of Lambda controller 22 is closed, which condition is also signaled to the sequential control block 34, the tank vent control will commence very smoothly, and the pulse duty factor of tank venting TVTE will be increased in a ramp-like manner, starting from a predetermined minimum value $TVTE_{min1}$, however, with change limitation 1, as shown in FIG. 9*b*. The increase in the pulse duty factor of the drive pulse train for the tank vent valve is chosen such that the anticipatory control (to be explained further below) can timely compensate for the resultant disturbance in the mixture composition of the internal combustion engine.

The deviation of the Lambda control factor caused by this change (see characteristic curve of FIG. 9*a* where the fuel proportion in the tank venting mixture is assumed to be 100% at the time the pulse duty factor TVTE is increased) from the desired value $F_R=1$ (see characteristic curve of FIG. 9*d*) towards a rich mixture causes a drift of the correction value which is subsequently included in the calculation of the injection signal, such that a constant fuel or air quantity is compensated, independently of load and rotational speed. The result is the adaptive anticipatory control with tank venting (see also the characteristic curve of the adaptation value ATE of FIG. 9*c*) which increases up to a maximum negative value $ATE_{max}$, thereby acting upon the Lambda control as an adaptive anticipatory control with tank venting as already explained in the foregoing with reference to the block diagram of FIG. 8.

The pulse duty factor will continue to be increased until the adaptation value ATE has reached a minimum negative threshold $ATE_{min}$ which may also be referred to as the lean limit stop related to the adaptation value. A limit value control sets in subsequently. Prior to this, at time $t_1$, the pulse duty factor TVTE may already have reached an anticipatory control limit stop which may ensue from the anticipatory control characteristic field; therefore, the pulse duty factor will not be changed any more until time $t_2$ when the negative threshold $ATE_{min}$ is reached. Thereafter, from $t_2$ on, the pulse duty factor TVTE will be decremented until ATE again drops below the above-mentioned threshold (in the positive direction). This is followed by an incrementation of the pulse duty factor until the threshold is again exceeded in the negative direction and so on.

In this manner, a continuous oscillation about the negative minimum value (predetermined lean limit stop) results (limit value control), with the limitation of change of the pulse duty factor acting like an integral component (ITE). Therefore, the pulse duty factor is as given below:

$$TVTE = KFTE(n, t_L) - ITE(ATE_{min})$$

Generally, the fuel from the intermediate storage diminishes as the operating period increases, so that in this limit-value control, the anticipatory control value from the characteristic field 16 is reached, the pulse duty factor remaining thus constant during a predetermined period of time in which the adaptation value ATE moves from the negative limit stop in the positive direction.

When the adaptation value reaches a positive threshold $ATE_{max}$ (rich limit stop), this means that the filter is sufficiently scavenged (the two threshold-value data are directed to the sequential control block 34 via the threshold block 36) and from time $t_3$ on, the pulse-duty factor will decrement in steps towards a second minimum value $TVTE_{min2}$.

At the same time and after this second minimum value is reached, the basic adaptation function in block 32 (adaptation without tank venting) can then be released by switch S3 for a predetermined (programmable) time (of the order of magnitude of several minutes).

After this predetermined period has elapsed, the tank venting mixture will be checked. This is accomplished by block 34 restarting the pulse duty factor control sequence just described; in this connection, it is to be noted that the pulse duty factor is regulated to the minimum value $TVTE_{min2}$ with a change limitation of 2 which enables the pulse duty factor to adapt to small cross sections of passage of the tank vent valve faster.

Figure 10:
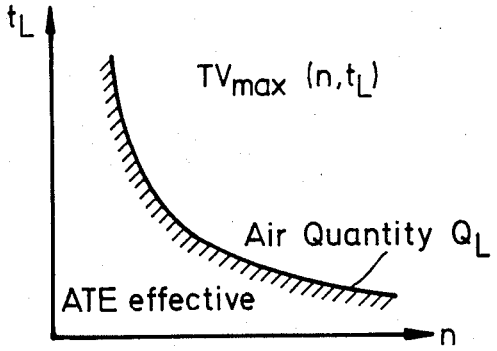
FIG. 10 is a graphical representation showing the range of tank venting adaption in the load-speed diagram.

This adaptation of the tank vent anticipatory control is suitably restricted to a load-speed range which is only effective below an air quantity threshold, as illustrated in FIG. 10, because it is only in this range that a sufficiently accurate calculation is possible. Moreover, the adapted value ATE is suitably stored in a memory store of tank vent adaptation block 35 (for application approximately when the Lambda sensor has in the meantime become inactive) only with the engine running; it will be deleted again when the engine is turned off.

Above the range indicated in FIG. 10, the tank vent anticipatory control adaptation is interrupted, and the ATE value last adapted will be temporarily stored in the memory store (not shown) of block 35. Above the effectiveness range of the tank vent anticipatory control adaptation of FIG. 10, the tank venting mixture deliverable via characteristic field KFTE can be of a magnitude making the impact on the Lambda control negligible (the tank venting quantity is proportional to the air quantity), so that in this sub-range the basic adaptation can also be effective during tank venting. Stated otherwise, switch S3 in this case is switched to block 32 which can also be accomplished by sequential control block 34 by evaluating load and speed information.

Figure 11:
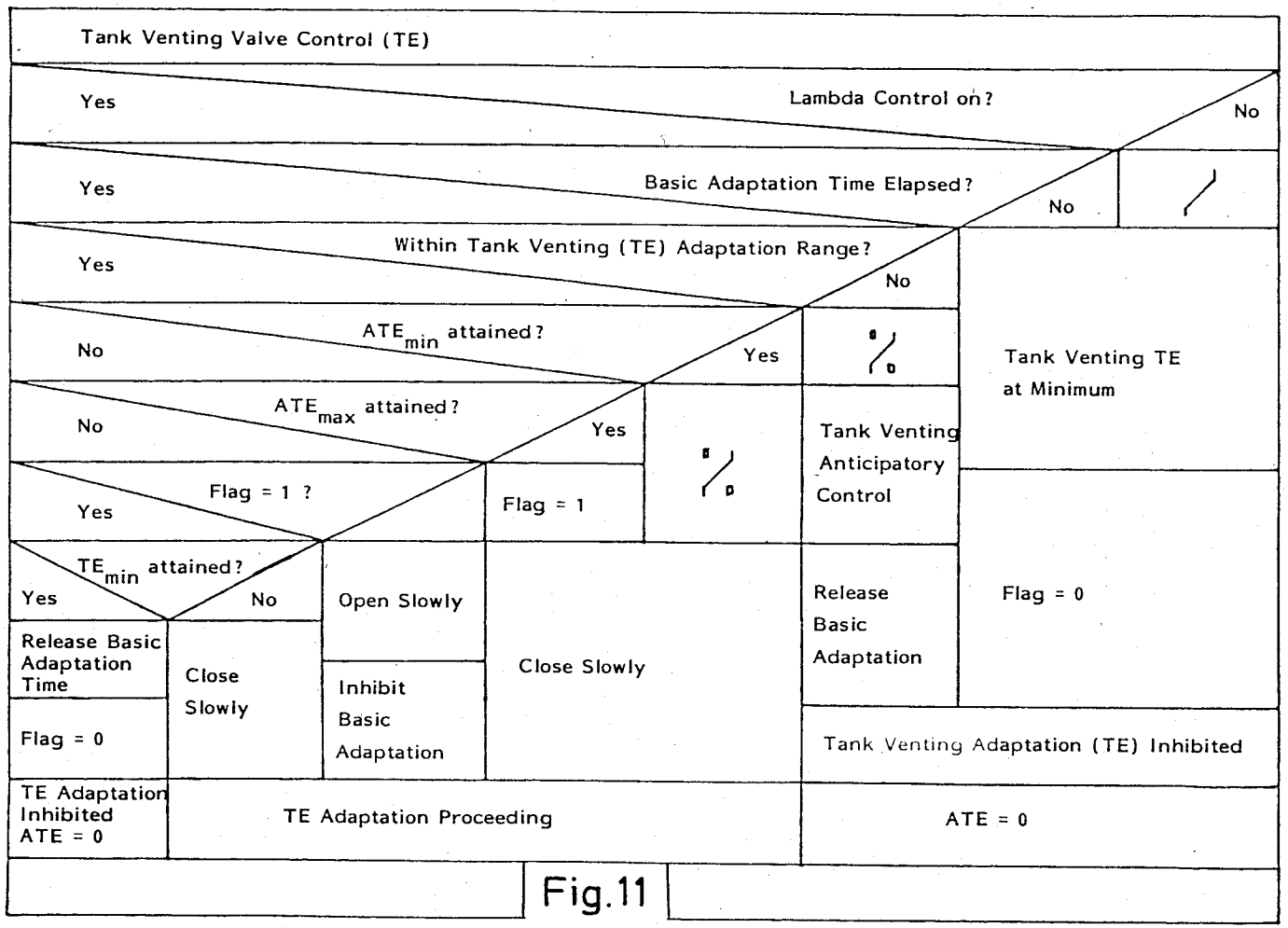
FIG. 11 is a flow chart illustrating the function in softward terms of the control block 34 of the block diagram of FIG. 8; and, FIG. 12 is a table listing the variants for the anticipatory control of tank venting.

The flowchart provided in FIG. 11 illustrates in software terms the function of the sequential control block 34 for controlling the tank venting valve. Although, for a better understanding, the invention has been explained with reference to a block diagram using individual components, it is understood that it is also within the scope of the invention to implement the apparatus of the invention by software tools using a microprocessor or microcomputer; such an embodiment presents no problem to those skilled in the art of fuel metering systems for internal combustion engines, since they may also draw on the experience of data processing experts if the need arises.

In the following, the variants for the anticipatory control of tank venting are listed; for better clarity, they are also summarized in the table entitled "Tank Venting Decision Matrix Table" which is provided in FIG. 12.

1. To obtain tank venting quantity per time (variant 1.1), the tank venting line opens into the intake ducting upstream of the throttle flap, as previously explained. Because in this embodiment the quantity of the tank venting mixture inducted is approximately constant with the cross section of passage of the tank venting valve remaining unchanged, this quantity need only have a comparatively small variation capability of the order of 1:20 to realize the functions previously mentioned and to maintain the minimum and maximum values.

The further anticipatory control alternatives are summarized by their individual evaluation criteria in the form of the decision matrix table referred to above.

2. In order to obtain a constant relative tank venting error (variant 1.2), the tank venting line is connected upstream of the throttle flap as in the previous embodiment. The characteristic field is configured such that the tank venting quantity is proportional to the air quantity (up to a predetermined maximum quantity which is about ten times the idle air quantity). In this load and speed range, the relative error is thus constant. However, the scavenging quantity is relatively small in the idling range, for $$KFTE \sim (\Delta_p)^{-\frac{1}{2}} \cdot Q_L \qquad \text{Variation 1:8}$$

Therefore, $$Q_{TE} = \text{const} \cdot Q_L$$

3. To obtain a constant tank venting quantity per revolution (variant 2.1), the tank venting line would have to be connected with the intake pipe downstream of the throttle flap, in which case, however, the underpressure would vary substantially more. With the underpressure increasing, the flow would not be laminar any more, but definitely turbulent, until the critical pressure ratio is reached at which the flow is at sound velocity; when the pressure ratio is overcritical, the quantity is constant. This involves a complex computation procedure, and the information that follows merely gives a rough estimate which is based on the assumption that Bernoulli's equation applies.

In this variant, however, the tank vent valve has to handle a substantially larger variation in order to maintain the above-identified minimum and maximum quantities; that is a variation of 1:110, because:

$$Q_{TEmin/max} = 1/20;\ \Delta P_{min/max} = 30/900.$$

On the other hand, in order to ensure that the error introduced by the tank venting function is constant per revolution, the tank venting characteristics would have to have a greater variation which is useful for an additive adaptation (here additive to $t_L$).

Thus, the following approximations apply:

$$Q_{TE} = \text{const} \cdot KFTE(\Delta p)^{\frac{1}{2}}$$
$$\Delta p = P_{air} - P_{intake}$$
$$30 < \Delta p < 900 \text{ mbar}$$
$$\text{with } KFTE \sim (\Delta p)^{-\frac{1}{2}}/n \qquad \text{Variation 1:22 (on variation speed 1:4)}$$

it follows:

$$Q_{TE} = \text{const}/n \rightarrow \Delta t_{L\ =\ const}$$

4. To obtain a constant anticipatory control value (variant 2.2), the tank venting line is likewise connected to the intake pipe downstream of the throttle flap. In the simplest anticipatory control, that is, a fixed value instead of the characteristic field, underpressure and consequently the quantity would be subject to much stronger variations, so that the tank venting quantity would be at its maximum precisely in the idling and start-up range where tank venting is a particularly disturbing factor, whereas the scavenging quantity would become progressively less as the load increases, which is when tank venting becomes less and less disturbing, as is known from the system up to now. In a system measuring the air quantity, the error would be dependent on various quantities such as load (from air quantity) and rotational speed; an adaptation is therefore considered particularly complex, with the following approximation applying:

$Q_{TE}=\text{const}\cdot(\Delta p)^{\frac{1}{2}}$

Variants 1.1 and 1.2 are suited for systems generating an approximately constant pressure drop upstream of the throttle flap (air flow sensor with flap). Systems in which the pressure drop is very low particularly at idling (HLM, alpha/n, P/n), can only be covered by variant 2.1. If variant 2.1 of the tank vent anticipatory control has to be chosen (additive to $t_L$), suitable measures have to be taken. The inclusion of the tank vent adaptation in the calculation then occurs additively to $t_L$, and the adaptation range has to be limited by an upper $t_L$ threshold.

It is understood that the foregoing description is that of the preferred embodiments of the invention and that various changes and modifications may be made thereto without departing from the spirit and scope of the invention as defined in the appended claims.

What is claimed is:

1. Apparatus for venting a fuel tank of an internal combustion engine or the like comprising:

an active-carbon filter container for receiving the fuel vapors in the tank;

an electrically-controlled tank venting valve having a pass-through opening and being arranged between said active-carbon filter container and the engine; and, control means for continuously changing the cross section of said opening in dependence upon selected operating conditions so as to control the delivery of the tank ventilating mixture to said engine;

said control means including means for supplying said tank venting valve with a clocked drive pulse train changeable with respect to its pulse duty factor in dependence upon operating characteristic quantities of the engine for changing said cross section; and, the duty cycle (TVTE) of said drive pulse train for said tank venting valve being at least partially adjusted via an anticipatory control characteristic field via load ($t_L$) and rotational speed (n) between predetermined values.

2. The apparatus of claim 1, wherein said anticipatory control characteristic field (KFTE) includes at least 4×4 support points having the capability of interpolation and is configured so that the percentage increased richness of the combustible mixture is continuously of the same magnitude for a given tank ventilating mixture.

3. The apparatus of claim 1, comprising Lambda-control-dependent control means for controlling said pulse duty factor of said drive pulse train of said tank venting valve thereby controlling the cross section of said opening.

4. The apparatus of claim 3, said Lambda-control-dependent control means of said pulse duty factor (TVTE) occurring along a mean-value characteristic of the Lambda-control factor $\overline{F}_R$ in such a manner that an increasing richness of said tank ventilating mixture over the mean value of said factor is recognized and that the tank ventilation of the tank is correspondingly closed by means of a corresponding reduction of said pulse duty factor.

5. The apparatus of claim 1, said pulse duty factor (TVTE) of the drive pulse train being subjected to a limit-value control with said pulse duty factor with the pulse duty factor being changed to effect a reduction of said cross section when the mean value of the Lambda control factor $\overline{F}_R$ exceeds a predetermined limit value $\overline{F}_{RGW}$ and with the pulse duty factor being changed to effect an increase in said cross section when the mean value of the Lambda control factor $\overline{F}_R$ drops beneath a predetermined limit value $\overline{F}_{RGW}$.

6. The apparatus of claim 1, wherein the tank ventilating is adaptively undertaken with a consideration of the Lambda control factor $F_R$ and the load ($t_L$) and rotational speed (n) by influencing the computed value of the fuel quantity to be supplied to the engine.

7. The apparatus of claim 6, said adaptation occurring arithmetically with time (on air quantity $Q_L$).

8. Apparatus for venting a fuel tank of an internal combustion engine or the like comprising:

intermediate storage means for receiving the fuel vapors in the tank;

an electrically-controlled tank venting valve having a pass-through opening and being arranged between said intermediate storage means and the fuel tank; and, control means for continuously changing the cross section of said opening in dependence upon selected operating conditions so as to control the delivery of the tank ventilating mixture to said engine;

the tank ventilating being adaptively undertaken with a consideration of the Lambda control factor $F_R$ or together with the load ($t_L$) and rotational speed (n) by influencing the computed value of the fuel quantity to be supplied to the engine; and, with a utilization of long-term deviations (mean-value formation) of the Lambda-control output as a measure for a correction of an adaptive, computed fuel-metered anticipatory control quantity, the controller output being switchable between the basic adaptation block 32 for the corrective influence of the computed fuel quantity and the tank venting adaptation block 35 for an adaptive value (ATE) of the tank vent at least at certain values of air quantity throughput and rotational speed such that basic adaptation is not influenced by the tank ventilation.

9. The apparatus of claim 1, wherein a characteristic field anticipatory control block is provided containing pulse duty factor values stored for the drive pulse train of the tank ventilating valve, said characteristic field anticipatory control block providing predetermined values of the pulse duty factor, in dependence upon load ($t_L$) and rotational speed (n) and supplying said values to a multiplication stage 15.

10. Apparatus for venting a fuel tank of an internal combustion engine or the like comprising:

intermediate storage means for receiving the fuel vapors in the tank;

an electrically-controlled tank venting valve having a pass-through opening and being arranged between said intermediate storage means and the fuel tank;

control means for continuously changing the cross section of said opening in dependence upon selected operating conditions so as to control the delivery of the tank ventilating mixture to said engine;

said intermediate storage means being an active-carbon filter container; said tank venting valve being a solenoid valve; and, said control means including means for supplying said solenoid valve with a clocked drive pulse train changeable with respect to its pulse duty factor for changing said cross section;

Lambda-control-dependent control means for controlling said pulse duty factor of said drive pulse train of said solenoid valve thereby controlling the cross section of said opening;

a characteristic field anticipatory control block being provided containing pulse duty factor values stored for the drive pulse train of the tank ventilating valve, said characteristic field anticipatory control block providing predetermined values of the pulse duty factor, in dependence upon load ($t_L$) and rotational speed (n) and supplying said values to a multiplication stage 15; and, said multiplication stage 15 being supplied with a further output signal of a characteristic block 24, which makes available predetermined values of the pulse duty factor in dependence upon the course of the mean value $\overline{F}_R$ of the Lambda control factor for general evaluation or in combination with the values of the anticipatory characteristic field.

11. Apparatus for venting a fuel tank of an internal combustion engine or the like comprising:

intermediate storage means for receiving the fuel vapors in the tank;

an electrically-controlled tank venting valve having a pass-through opening and being arranged between said intermediate storage means and the fuel tank; and, control means for continuously changing the cross section of said opening in dependence upon selected operating conditions so as to control the delivery of the tank ventilating mixture to said engine;

said control means including means for supplying said venting valve with a clocked drive pulse train changeable with respect to its pulse duty factor for changing said cross section;

said pulse duty factor (TVTE) of the drive pulse train being subjected to a limit-value control with said pulse duty factor with the pulse duty factor being changed to effect a reduction of said cross section when the means value of the Lambda control factor $\overline{F}_R$ exceeds a predetermined limit value $F_{RGW}$ and with the pulse duty factor being changed to effect an increase in said cross section when the mean value of the Lambda control factor $\overline{F}_R$ drops beneath a predetermined limit value $\overline{F}_{RGW}$; and, a comparator location 25 to which are applied a limit value $\overline{F}_{RGW}$ of the means value of the Lambda control factor and the Lambda control factor; a comparator 26 connected to the output of said comparator location for determining the sign, and an integrator 27 for generating a changing pulse duty factor for the drive pulse train and for supplying the same to the multiplier stage 15 alternatively to the characteristic dependent displacement and, if required, supplementary to the evaluation of the anticipatory control characteristic field, said integrator being containously altered with predetermined constants.

12. Apparatus for venting a fuel tank of an internal combustion engine or the like comprising:

intermediate storage means for receiving the fuel vapors in the tank;

an electrically-controlled tank venting valve having a pass-through opening and being arranged between said intermediate storage means and the fuel tank; and, control means for continuously changing the cross section of said opening in dependence upon selected operating conditions so as to control the delivery of the tank ventilating mixture to said engine;

the tank ventilating being adaptively undertaken with a consideration of the Lambda control factor $F_R$; and, a sequential control circuit 34 for the adaptive anticipatory control for ventilation, a tank ventilating adaptation block 35 driven by said sequential control circuit 34, said adaptation block 35 making an anticipatory adaptation value (ATE) available by evaluating an averaged value of the Lambda control factor $\overline{F}_R$, said adaptation block 35 determining the computed sequence for the fuel quantity to be metered to the engine such that a constant fuel quantity or air quantity per unit of time is compensated for independently of load and rotational speed.

13. The apparatus of claim 12, comprising control means for controlling said sequential control circuit in the sense of a correspondingly directed change of the pulse duty factor (TVTE), said last-mentioned control means responding to predetermined maximum and minimum values ($ATE_{max}$, $ATE_{min}$) of the adaptive anticipatory correction value for tank ventilation (ATE).

14. The apparatus of claim 11, wherein, with an active Lambda control, the pulse duty factor (TVTE) of the drive pulse sequence for said tank venting valve is ramp-shaped with a predetermined first change limitation and is increased from a minimum value ($TVTE_{min1}$) until a negative maximum threshold value ($ATE_{min}$—lean stop) of the adaptation value (ATE) is reached with the reduction originating herefrom of the pulse duty factor of the drive pulse sequence until dropping beneath said threshold value with a subsequent slow increase to the formation of a permanent oscillation about the negative minimum threshold ($ATE_{min}$).

15. The apparatus of claim 14, wherein said pulse duty factor (TVTE) of the drive pulse train is held constant at a predetermined value when there is a pass-through increase in the positive direction of the adaptive value (ATE) from the negative stop and, after reaching a positive maximum stop value ($ATE_{max}$), a change of the pulse duty factor is started with simultaneous release of the basic adaptation in the Lambda control-loop of the fuel quantity computation (computation of the injection signal).

16. The apparatus of claim 15, said predetermined value originating from the anticipatory control characteristic field and said change of said pulse duty factor being with a second steeper change limit.

17. The apparatus of claim 15, wherein a renewed testing of the tank ventilating mixture occurs via control of said pulse duty factor after said release of said basic adaptation (adaptation without tank ventilation) for a fixed predetermined programmable time.

18. The apparatus of claim 12, wherein the tank ventilating anticipatory control adaptation is limited to a predetermined load-speed range, which is effective beneath a given air-quantity throughput limit and beneath a given rotational speed limit, and above this range, with an interruption of the tank venting anticipatory adaptation and release of the basic adaptation for the computation of the fuel quantity (computation of the fuel injection signal), the determination of the pulse duty factor for the release of the tank ventilating mixture occurs via the stored characteristic field in dependence upon speed and load.

19. The apparatus of claim 18, wherein an intermediate storage of the last adaptation value (ATE) occurs with the transition out of the range of the tank ventilation anticipatory adaptation into the controlled characteristic field range of the tank ventilating mixture input, and wherein the adapted tank ventilation anticipatory control begins with said last adaptation value after a return to the adaptation range.

20. The apparatus of claim 14, wherein the tank ventilating quantity is formed in proportion to the air quantity and said adaptation operates multiplicatively.

21. The apparatus of claim 14, wherein the tank ventilating quantity is additively formed per stroke independently of the speed and the adaptation operates additively on the anticipatory control injection pulse $t_L$.

22. The apparatus of claim 21, wherein the range of adaptation in the upward direction is limited by the $t_L$-threshold.

23. The apparatus of claim 6, said adaptation occurring additively on injection quantity/stroke (a load signal $t_L$).

24. The apparaus of claim 1, wherein the tank ventilating is adaptively undertaken with a consideration of Lambda control factor $F_R$.

25. The apparatus of claim 24, said adaptation occurring arithmetically with time (on air quantity $Q_L$).

26. The apparatus of claim 24, said adaptation occurring additively on injection quantity/stroke (a load signal $t_L$).

27. Apparatus for venting a fuel tank of an internal combustion engine or the like comprising:

intermediate storage means for receiving the fuel vapors in the tank;

an electrically-controlled tank venting valve having a pass-through opening and being arranged between said intermediate storage means and the fuel tank; and, control means for continuously changing the cross section of said opening in dependence upon selected operating conditions so as to control the delivery of the tank ventilating mixture to said engine;

the tank ventilating being adaptively undertaken with a consideration of the Lambda control factor $F_R$;

with a utilization of long-term deviations (mean-value formation) of the Lambda-control output as a measure for a correction of an adaptive, computed fuel-metered anticipatory control quantity, the controller output being switchable between the basic adaptation block 32 for the corrective influence of the computed fuel quantity and the tank venting adaptation block 35 an adaptive value (ATE) of the tank vent at least at certain values of air quantity throughput and rotational speed such that the basic adaptation is not influenced by the tank ventilation.

28. The apparatus of claim 12, wherein the tank ventilating is adaptively undertaken with a consideration of also the load ($t_L$) and rotational speed (n) by influencing the computed value of the fuel quantity to be supplied to the engine.

29. The apparatus of claim 1, wherein said tank venting valve being a solenoid valve.

30. The apparatus of claim 1, comprising Lambda control means and wherein the clocked control of said tank venting valve being subjected to complete adaptive Lambda control pursuant to said characteristic field.

* * * * *

UNITED STATES PATENT AND TRADEMARK OFFICE

CERTIFICATE OF CORRECTION

PATENT NO. : 4,683,861

DATED : August 4, 1987

INVENTOR(S) : Helmut Breitkreutz et al

It is certified that error appears in the above-identified patent and that said Letters Patent is hereby corrected as shown below:

On the title page, in the heading: delete "Breitkreuz et al." and substitute -- Breitkreutz et al. -- therefor.

On the title page, under "Inventors": delete " Helmut Breitkreuz" and substitute -- Helmut Breitkreutz -- therefor.

In column 3, line 48: delete "softward" and substitute -- software -- therefor.

In column 7, lines 21 and 22 : delete "$T_{MO-T}$" and substitute -- $T_{MOT}$ -- therefor.

In column 7, line 31: delete "$\Delta F_R 5\%$" and substitute -- $\Delta F_R < 5\%$ -- therefor.

UNITED STATES PATENT AND TRADEMARK OFFICE

CERTIFICATE OF CORRECTION

PATENT NO. 4,683,861

DATED August 4, 1987

INVENTOR(S) Helmut Breitkreutz et al

It is certified that error appears in the above-identified patent and that said Letters Patent is hereby corrected as shown below:

In column 12, line 16: delete "$(\Delta_p)$" and substitute -- $(\Delta p)$ -- therefor.

In column 12, line 41: delete "$\Delta P$" and substitute -- $\Delta p$ -- therefor.

In column 12, line 52: delete "$P_{air} - P_{intake}$" and substitute -- $p_{air} - p_{intake}$ -- therefor.

In column 12, line 56: delete "$\Delta t_L = const$" and substitute -- $\Delta t_L = const$ -- therefor.

UNITED STATES PATENT AND TRADEMARK OFFICE

CERTIFICATE OF CORRECTION

PATENT NO. : 4,683,861

DATED : August 4, 1987

INVENTOR(S) : Helmut Breitkreutz et al

It is certified that error appears in the above-identified patent and that said Letters Patent is hereby corrected as shown below:

In column 13, line 50: after the word "values" add -- (0% to 100%; $TVTE_{min1}$, $TVTE_{min2}$, $TVTE_{max}$) --.

In column 14, line 49: after the word "that" insert the definite article -- the --.

In column 15, line 50: delete "means" and substitute -- mean -- therefor.

In column 15, line 57: delete "means" and substitute -- mean -- therefor.

In column 16, line 18: delete "for ventilation" and substitute -- for tank ventilation -- therefor.

UNITED STATES PATENT AND TRADEMARK OFFICE

CERTIFICATE OF CORRECTION

PATENT NO. : 4,683,861

DATED : August 4, 1987

INVENTOR(S) : Helmut Breitkreutz et al

It is certified that error appears in the above-identified patent and that said Letters Patent is hereby corrected as shown below:

In column 17, line 32: delete "apparaus" and substitute -- apparatus -- therefor.

In column 18, line 23: after "block 35" insert -- for --.

Signed and Sealed this

Twentieth Day of September, 1988

*Attest:*

DONALD J. QUIGG

*Attesting Officer*

*Commissioner of Patents and Trademarks*